US005537693A

United States Patent [19]

Dossola et al.

[11] Patent Number: 5,537,693

[45] Date of Patent: Jul. 23, 1996

[54] TOILET SEAT COVER

[76] Inventors: Liliana L. Dossola; Federico J. Dossola; Pablo T. Dossola, all of 1304 Daviswood Dr., McLean, Va. 22102

[21] Appl. No.: 282,501

[22] Filed: Aug. 1, 1994

Related U.S. Application Data

[63] Continuation-in-part of Ser. No. 19,672, Feb. 19, 1993, abandoned.

[51] Int. Cl.[6] ..... A47K 13/14

[52] U.S. Cl. ..... 4/245.400; 4/245.007

[58] Field of Search ..... 4/245.1–245.9

[56] References Cited

U.S. PATENT DOCUMENTS

| | | | |
|---|---|---|---|
| 992,173 | 5/1911 | Darms . | |
| 1,006,915 | 10/1911 | Curtis . | |
| 1,088,090 | 2/1914 | Quackenbush . | |
| 1,283,533 | 11/1918 | Leighton . | |
| 1,538,147 | 5/1925 | Trench et al. . | |
| 1,706,960 | 9/1927 | Kobatake . | |
| 1,997,738 | 4/1935 | Maxedon et al. . | |
| 3,851,314 | 12/1974 | Aoyama . | |
| 3,874,008 | 4/1975 | Warnberg . | |
| 4,050,105 | 9/1977 | Marceaux | 4/245.4 |
| 4,227,267 | 10/1980 | Robertson . | |
| 4,586,202 | 5/1986 | Uchida . | |
| 4,589,149 | 5/1986 | Bassi . | |
| 4,766,617 | 8/1988 | Thygesen et al. . | |
| 4,850,061 | 7/1989 | Engel | 4/245.4 |
| 4,979,237 | 12/1990 | Hazar et al. . | |
| 4,998,297 | 3/1991 | Summerville . | |
| 5,131,290 | 7/1992 | Atkinson . | |
| 5,193,229 | 3/1993 | Smith . | |

FOREIGN PATENT DOCUMENTS

| | | | |
|---|---|---|---|
| 2616314 | 12/1988 | France . | |
| 0082421 | 1/1991 | Japan | 4/245.4 |

*Primary Examiner*—Charles E. Phillips
*Attorney, Agent, or Firm*—James Creighton Wray

[57] ABSTRACT

A sanitary toilet seat cover has a sheet of flexible wipeable plastic material or the like in an annular shape to overlie upper and lower surfaces and outer and inner edges of a toilet seat. The toilet seat cover has a peripheral elastic rim on the outer edge and five flaps on the inner edges. The peripheral elastic rim forms a flexible elastic outer edge which pulls the cover tightly around and inward under the toilet seat. Five pressure adhesive discs are held on a release sheet and are peeled from the release sheet and applied half to outer edges of the flaps where they overlap the cover, and half to the cover.

5 Claims, 4 Drawing Sheets

FIG. 1
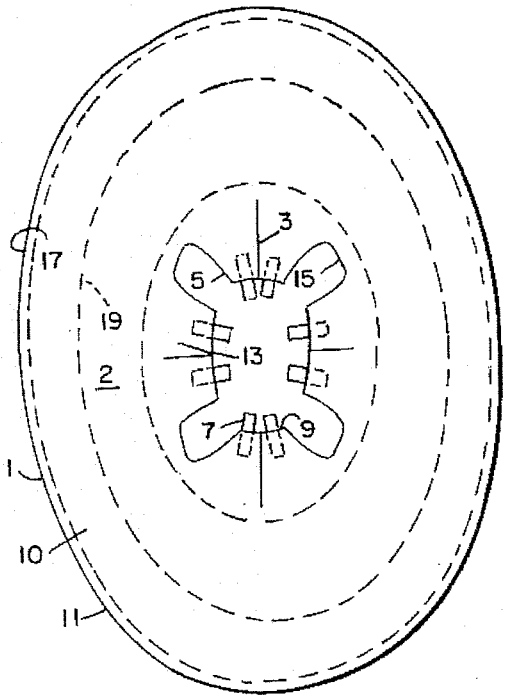
FIG. 2
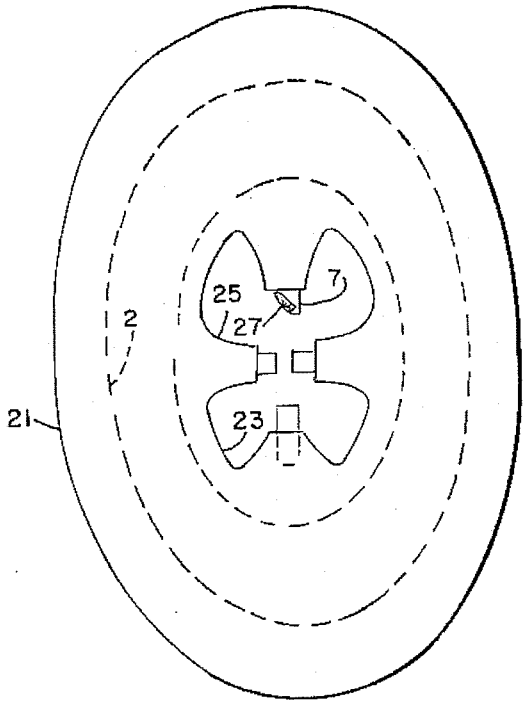
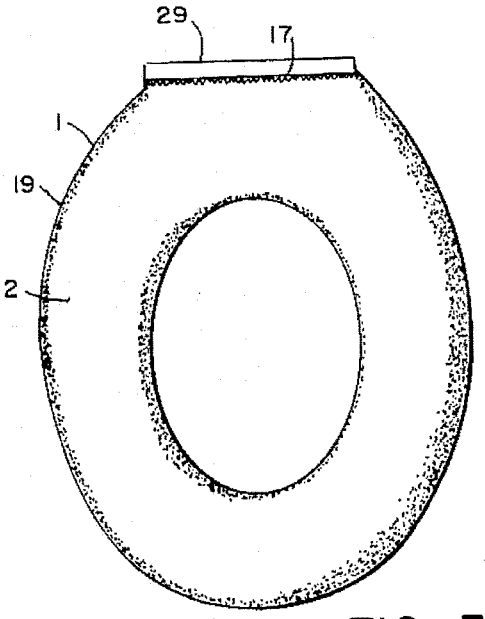
FIG. 3
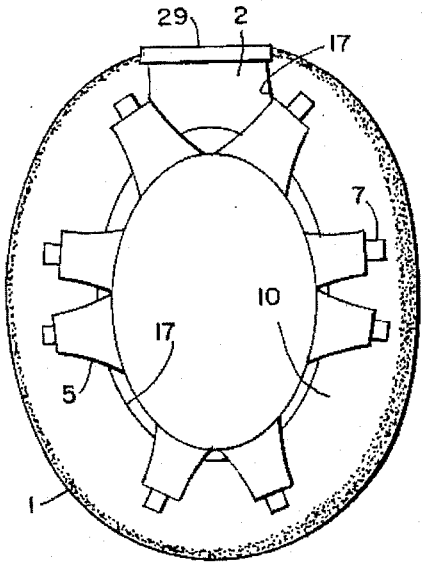
FIG. 4

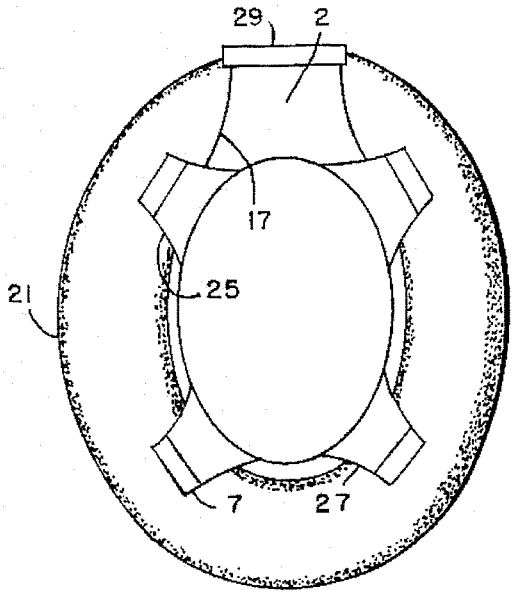
FIG. 5
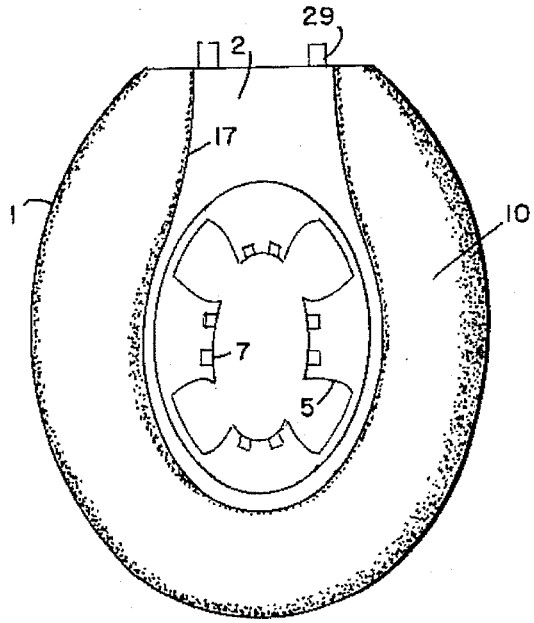
FIG. 6
FIG. 7
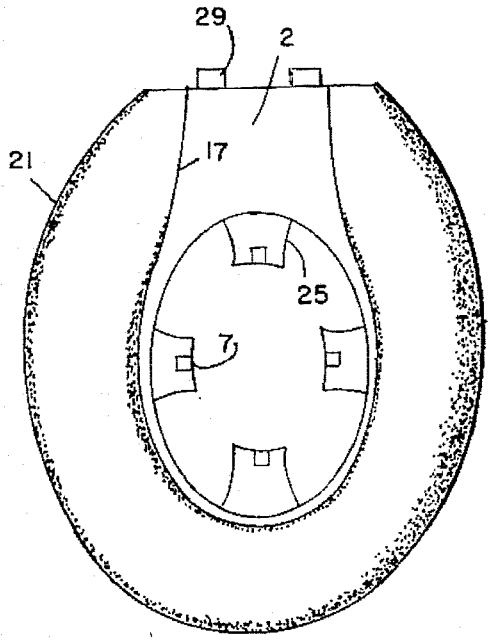
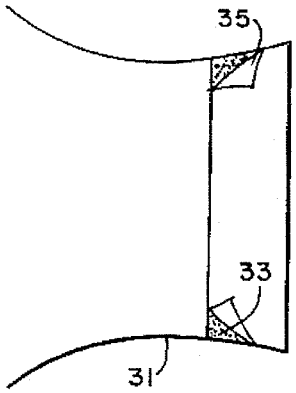
FIG. 8
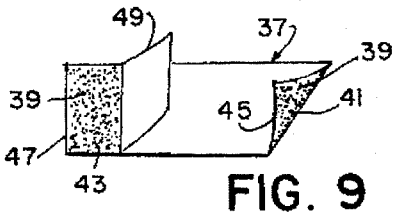
FIG. 9
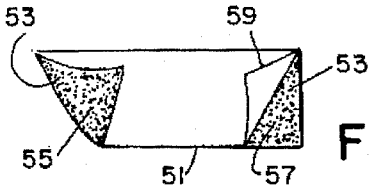
FIG. 10

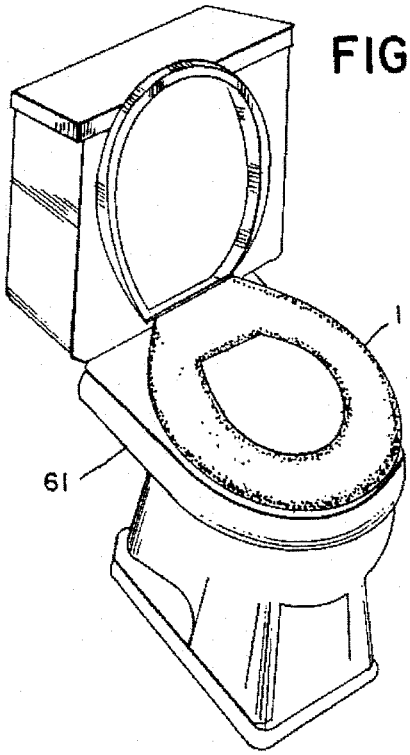
FIG. 11
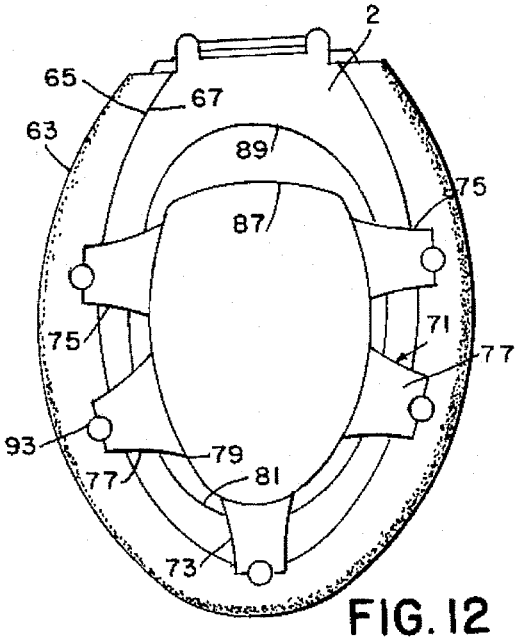
FIG. 12
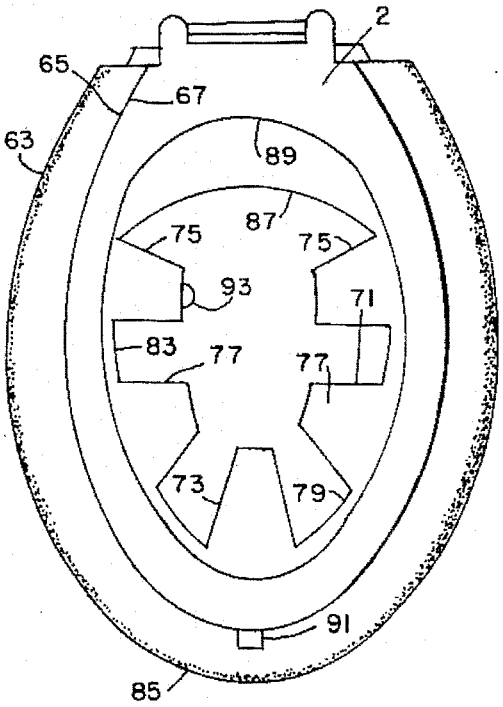
FIG. 13
FIG. 15
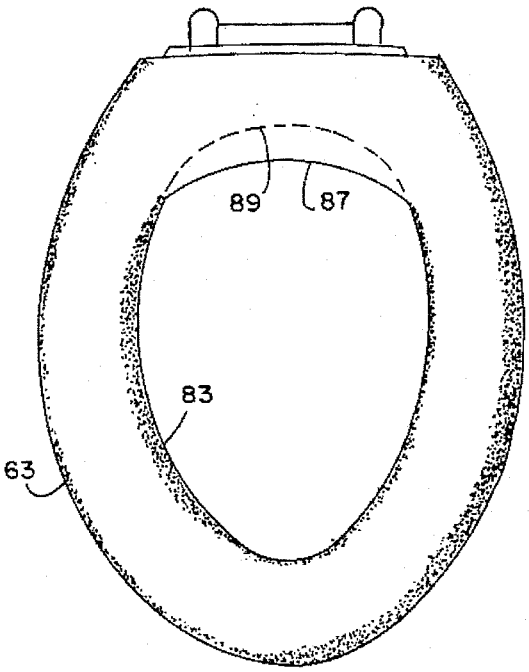

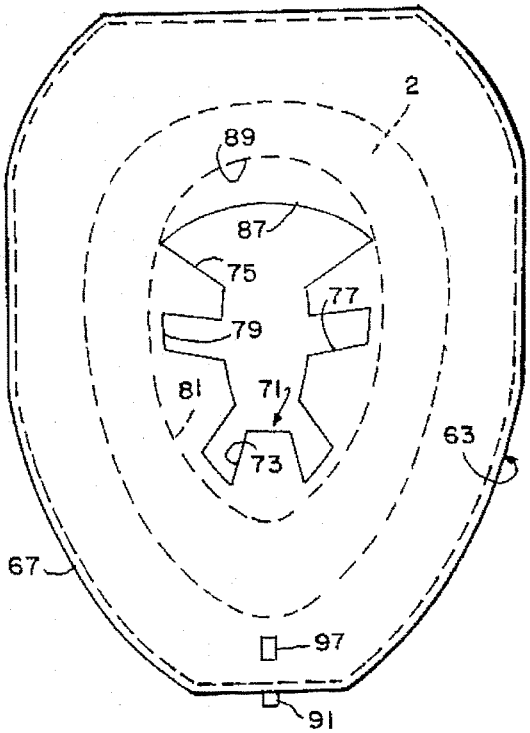
FIG. 16
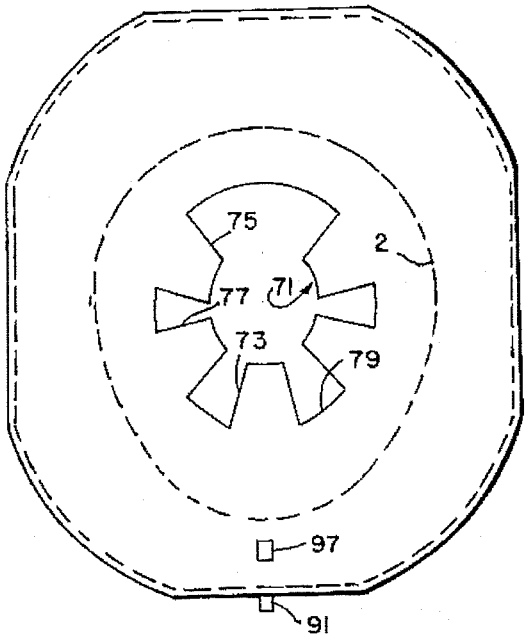
FIG. 17
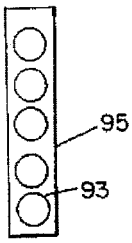
FIG. 14
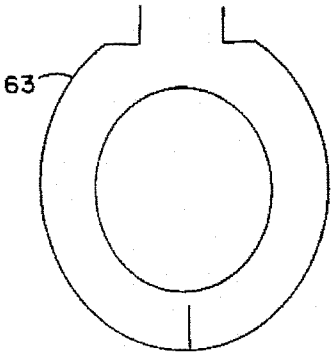
FIG. 18
FIG. 19
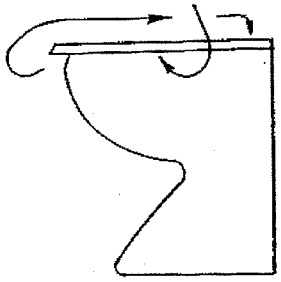

TOILET SEAT COVER

BACKGROUND OF THE INVENTION

This is a continuation-in-part of application Ser. No. 08/019,672 filed Feb. 19, 1993 now abandoned.

The present invention relates generally to sanitary toilet seat covers which are used for covering the seat of a toilet while in use. Particularly, this invention is directed to hotel travelers, patients in hospitals, and people who may be required to use public toilets. The device is useful in homes for guest bathrooms and sick rooms and for general use.

Toilet seat covers have been available for a number of years. The most common is a disposable toilet seat cover which comprises a single sheet of paper of a size to cover a toilet seat, with a cutout central portion detachably secured at one end to the outer portion which hangs down into the bowl to aid in drawing the seat cover down the drain when the toilet is flushed. That device, however, does not provide means to completely and securely cover a toilet seat, totally preventing the user's skin contact with the toilet seat. It tears easily, and it is not wipeable when damp; but it tends to soak.

While the paper tissue covers may be suitable for a single use, they are not suitable for repeated uses such as in a hotel room or hospital room where a family or an individual may use a toilet repeatedly over a limited period of time, such as for several days or weeks.

Moreover, the cutout tissue paper type of toilet seat covers is usually packaged in a large cardboard box of several covers. The box would be inconvenient to carry and to temporarily provide in a small bathroom environment.

When the conventional tissue seat covers are used, any ventilation or air movement tends to dislodge the covers immediately after they have been placed on seats, resulting in imperfect covering, discomfort or exposure to the public toilet seat. Edges of the public toilet seat may be exposed by shifting of the cover.

A need exists for an inoffensive toilet seat cover which may completely cover the seat so that the seat may be raised and lowered without touching the seat, or the cover getting dislodged. A need exists for a toilet cover for hotels, hospitals and guest or sick rooms in homes which may be periodically replaced for freshness.

A need exists for a wipeable toilet seat cover which provides the means for effectively preventing contact of the user with a toilet seat by securely and tightly covering the entire toilet seat and by remaining in place for a reasonably extended limited period of time.

A need exists for a cover to protect the seat itself effectively from contamination, for example during temporary use by an infected patient.

SUMMARY OF THE INVENTION

In general, the present invention is a sanitary toilet seat cover which is used for covering the seat of a toilet. The invention comprises a sheet of flexible plastic material or the like cut in an annular shape wide enough to cover the lower and upper sides of a toilet seat, having a central opening portion slightly smaller than a central opening portion of a toilet seat.

Health and prevention of communicable diseases are the main objectives of the invention. A secondary advantage is the protection and prolongation of useful life of toilet seats in hotels and hospitals.

An object of the present invention is to provide a sanitary toilet seat cover which wraps around a seat and with outer and inner edge features which secure the cover to a seat for multiple uses over a limited period of time.

Another object of the present invention is to provide a sanitary toilet seat cover with a peripheral elastic rim on its outer edge and plural flaps having pressure sensitive adhesive on inner edges to secure the multiple use protective cover to itself or to a seat.

Advantages of the invention are found on the adjustable means of the toilet seat cover, which include the peripheral elastic rim and the plural flaps. The invention will fit almost any size toilet seat.

In a preferred embodiment of the invention, the device is cut in a specific shape from a flexible plastic sheet. An annular shape is formed by providing a central opening portion with a diameter equal or slightly smaller than the central opening of a toilet seat. Flaps extend from the inner edge and join an outer edge portion of the cover under the seat. The outer edge in a preferred embodiment is constructed with a peripheral elastic rim for pulling the seat cover tightly inward around an edge of a base of the toilet seat. The inner edge is slit to form five strategically located flaps. Pressure sensitive adhesive material beneath the flaps holds the flaps in contact with the inward pulled outer edge of the cover. The adhesive presses against the elastic edge of the seat cover to hold the cover tightly. Preferably the adhesive-coated discs are attached to a release strip. The discs peel off to expose the adhesive.

Drawing inward and then downward and outward on the flaps ensures that the inner edge of the cover is positioned below the seat.

Preferably the seat cover is made oversize to accommodate wide ranges of seat breadths and thicknesses. The elastic band sewn in a fold in the outer edge pulls the outer edge inward to near the inner edge of the seat base so that substantially the entire seat is covered. The elastic band conforms the rearward portion of the seat cover to abut the hinges on the rear of the seat.

The toilet seat cover can have strips attached to the flaps. The strips have pressure sensitive adhesive on opposite faces or on opposite ends of opposite faces. In the latter case, one end face adheres to the flap and the opposite end face has a release sheet which is removed before adhering that end to the outer portion of the cover which has been pulled under the seat.

In a preferred form of the invention, each seat cover is packaged in a small sealed plastic container, such as, for example, of size which might hold a shower cap. One or more packages which contain covers are placed on a counter in each hotel or hospital bathroom. A hotel guest opens a package and quickly places a seat cover on the seat. Easy to follow instructions enclosed in the package feature a system that allows the user to install the cover without touching the seat, which is customarily presented in a lowered position, resting on the bowl, at hotels, etc. The sequence can be reversed to discard or remove the cover after use, without touching the seat. The invention is easy to use by sliding the cover over the seat according to the instructions, then pressing the flaps into place.

These and further and other objects and features of the invention are apparent in the disclosure, which includes the above and ongoing written specification, with the claims and the drawings.

BRIEF DESCRIPTION OF THE DRAWINGS

FIG. 1 is a top plan view of the seat cover blank slit to form eight flaps.

FIG. 2 is a top plan view of the seat cover blank slit to form four flaps.

FIG. 3 is a top plan view of the toilet with a seat cover in place.

FIG. 4 is a bottom view of a toilet seat embodying the device shown in FIG. 1 with eight flaps in place.

FIG. 5 is a bottom view of a toilet seat embodying the device with four flaps in place.

FIG. 6 is a bottom view of a toilet seat embodying the device shown in FIG. 1, with eight flaps before being adjusted to the toilet seat.

FIG. 7 is a bottom view of a toilet seat embodying the device shown in FIG. 2, with four flaps before being adjusted to the toilet seat.

FIG. 8 is a bottom view detail of the slit flaps, having the adhesive-coated areas covered by release strips.

FIG. 9 is a detail of a tape having opposite end faces coated with adhesive.

FIG. 10 is a detail of a double sided pressure sensitive tape for securement to the seat cover.

FIG. 11 is a perspective view of a toilet with a covered seat embodying the device of the present invention.

FIG. 12 is a bottom view of a preferred cover installed on a toilet seat.

FIG. 13 is a bottom view of the toilet seat showing the flaps before they are folded over the cover.

FIG. 14 is a detail of five adhesive backed discs mounted on a release sheet.

FIG. 15 is a top view of the toilet seat after the preferred cover has been attached.

FIG. 16 shows the elongated special shaped die cut cover before the elastic is attached, showing positioning of the colored locator tab.

FIG. 17 is a shorter regular shaped toilet seat cover showing the die cut form before the elastic is attached, and showing the location of the tab.

FIG. 18 is a top view of the toilet seat cover showing the seat cover as it is attached to a toilet seat.

FIG. 19 shows steps in attaching the toilet seat cover to the toilet seat.

DETAILED DESCRIPTION OF THE DRAWINGS

Referring to the drawings, and more particularly to FIG. 1, a toilet seat cover is generally indicated by the numeral 1. Seat cover 1 is constructed from a single sheet of flexible plastic material or the like, cut in an annular shape to wrap around, overlie, and underlie a toilet seat 2. Seat cover 1 is die cut from a plastic sheet, for example 5–8 mil polyethylene or other suitable wipeable plastic material. The flaps are slit 3 to provide eight flaps 5. A mounting strip 7 is attached to the loose end 9 of each flap. The strips have pressure sensitive adhesive on their inner edges to be pressed against an outer edge of the toilet seat cover and to keep the cover in place. Preferably the strips 7 and release sheets are made of colors which contrast with the seat cover to make them easily identifiable during installation. The toilet seat cover 1 has an outer annular portion 10 with an outer edge 11, an inner annular portion 13 with an inner edge 15 of a central opening, with a size slightly smaller than the sizes of central openings of conventional toilet seats. The outer edge 11 has a peripheral elastic rim 17, constructed for pulling the outer edge of the cover inward below a toilet seat 19 to conform the cover to a molded seat and for holding the toilet seat cover tightly inward around the toilet seat, as shown in FIGS. 3, 4, 5 and 6. The elastic rim may be formed by folding a seam around a stretched elastic cord connected as a hoop, or by sewing or bonding stretched elastic threads or yarns along the periphery.

A preferred way of making the invention is to die cut a blank, forming the flaps. Then the outer edge is folded inward around an elastic cord and sewn to the cord. Then the adhesive and release sheets are applied to the flaps.

FIG. 2 shows a toilet seat cover 21 with the inner edge 23 cut to form four flaps 25 with strips on their loose ends. Pressure sensitive adhesive material 27 beneath the strips holds the flaps in contact with the pulled-inward cover, preventing the toilet seat cover from moving, as shown in FIGS. 4 and 5.

Any number of flaps may be used. For example, six flaps may be uniformly spaced to ensure proper cover securement.

As shown in FIGS. 1, 4 and 6 the toilet seat cover 1 may be slit to form eight flaps 5. FIG. 4 shows the strips 5 pressed against an outer annular portion 10 which has been drawn inward by the elastic edge 17 of the toilet seat cover 1. FIG. 6 shows the eight flaps 5 with strips, before being pressed against the elastic inward-drawn outer edge portion 10 of the toilet seat cover 1.

Alternatively, as shown in FIGS. 2, 5 and 7 the toilet seat cover 21 may be slit to have four flaps 25. In areas near the seat hinges 29 the flaps attach to an underside of the toilet seat, or preferably to the cover under the seat.

FIG. 3 shows a top plan view of the toilet seat cover 1 shown in FIGS. 1 and 2 after the seat cover has been assembled on a toilet seat 2. The seat cover 1 completely covers the toilet seat, extending around the outer edge of the toilet seat and the inner edge of the toilet seat, and extending to the hinge 29 at the back of the toilet seat. The elastic edge 17 is pulled up against the hinge 29, and the area along the hinge is the only position where the elastic edge 17 of the cover 1 extends above the toilet seat. It can be seen from FIG. 3 that the entire top of the toilet seat is covered. The cover 1 substantially covers the entire toilet seat, including wrapping around edges of the toilet seat and covering a substantial portion of the bottom of the toilet seat so that no contact is made with the toilet seat.

In FIG. 4, a bottom view of the toilet seat is shown in which the cover is pulled inward by the elastic edge 17 to completely surround the outer edge of the toilet seat and to extend substantially to the inner edge of the toilet seat.

As shown, the toilet cover 1 is flexible, and the elastic edge 17 tends to shape and form the cover to the seat. The elastic edge 17 extends entirely around the toilet seat cover 1, and extends principally below the toilet seat in use, with a small portion of the edge extending above the hinges 29.

As seen in the drawing, the flaps 5 pull the inner edge of the toilet seat cover 1 downward and outward so that the inner edge of the toilet seat is covered and so that the flaps overlie a portion 10 of the cover 1.

The adhesive tabs 7 secure the flaps to the portion 10 of the cover so that substantially the entire toilet seat 2 is covered.

Referring to FIG. 5, the embodiment of the toilet seat cover 21 with four flaps 25 is shown. Each of the flaps is pulled downward and outward so that the outer portions 27 of the flaps overlie the portion of the seat cover that is pulled inward by elastic edge 17. The adhesive tabs 7 secure the outer portions 27 of the flaps to the face of the seat cover. The elastic edge extends around the seat and extends rearward and over the hinges 29.

FIG. 6 shows the bottom view of the eight flap toilet seat cover 1 before the flaps 5 are pulled downward and outward to press the adhesive portions 7 to the cover. The initial position of the seat cover 1 is shown, after the seat cover has been pulled over the toilet seat 2, and before the flaps have been pulled downward and outward to overlie the portion 10 of the seat cover along the elastic edge 17, and to secure the seat cover in position by pressing the adhesive strips 7 against the seat cover.

FIG. 7 shows the alternate seat cover 21 with four flaps 25 in a bottom view, as positioned on the toilet seat 2 before the flaps 25 are pulled inward, downward and outward to cover the inner edge of the toilet seat and to secure the adhesive area 7 against the inner portion of the cover.

FIG. 8 shows an embodiment of the present invention wherein flaps 31 have adhesive-coated areas 33 covered by release strips 35 which can be peeled off to expose the adhesive for attaching to the cover.

FIG. 9 shows a detail of a double ended tape 37 which has adhesive 39 of opposite faces 41, 43 at opposite ends 45 and 47 of the tape. A face 41 is adhered to a flap 5. Adhesive on a face 43 is covered by a release sheet 49, which is removed before attaching that end of the tape to the inner edge portion of the seat cover 1.

FIG. 10 shows a double sided pressure sensitive adhesive tape 51 having adhesive 53 on both faces. One face 55 is permanently attached to flap 5. The other face 57 of the tape is covered by a release sheet, which is removed before adhering face 57 to the cover.

FIG. 11 shows the seat cover 1 in place on seat of a toilet 61. The overall appearance is one of a neatly covered toilet seat.

The cover of the present invention is useful with split toilet seats by attaching the tape on the front flap to the inward-pulled outer edge of the cover. The cover simply spans the gap in a split seat.

The invention has the advantage of protecting health and promoting peace of mind and comfort of users, and has the additional advantage of improving the life of toilet seats by preventing deterioration of the surface through repeated uses and cleanings of the seat.

As shown in FIGS. 12–19, a toilet seat 2 is covered by a preferred cover 63. An elastic band 65 secured in the outer edge 67 of the cover pulls the outer edge inward beneath the seat 2. Five flaps 71 pull the portions of the inner edge outward to stabilize the cover 63 on the seat. The flaps 71 include a frontal flap 73 centered in the front of the seat 2, rear flaps 75 and intermediate flaps 77. The inner edge 79 of the cover always remains inward from the inner edge 81 of the seat because the opening 83 in the cover is smaller than the opening in a majority of commercial type hotel and hospital seats 2. When the cover 63 is used on a U-shaped seat the flap 73 is secured to the forward part 85 of the cover, just as if the seat had an oval opening. On a U-shaped seat, the front flap 73 and the front part of the cover prevent contact with the front edge of the bowl. The rear edge 87 of the cover opening is cut to be well forward of the rear edge 89 of the seat opening so that no contact can be made with the rear edge of the seat.

In installation, a blue tab 91 on the front of the cover is aligned with a center of the front of the seat 2 or with the center of an opening in a U-shaped seat. Alternatively, the central flap 73 is located and is aligned with the seat center. While the seat 2 is down and resting on the toilet bowl, the cover 63 is pulled or drawn rearward over the seat. The five flaps 71 are allowed to fall downward through the central opening 79. The elastic pulls the outer edge of the cover inward under the seat. Then the seat is lifted, touching only the cover.

Individual adhesive dots 93 are removed from a backing strip 95 packaged with the seat cover 63, and the adhesive sides of the dots are attached half to the flap edges and half to the outer surface of the pulled-inward cover. The adhesive dots are plastic flexible discs with adhesive on one side. There is only one strip of backing to discard in the preferred embodiment.

The adhesive discs 93 and the backing strip 95 are best shown in FIG. 14.

FIG. 13 shows the bottom view of the toilet seat before the flaps are moved outward to overlap the inner edge 67 of the seat cover.

FIG. 15 shows the top view of the seat which has been covered. The inner edge 82 of the cover is inward from the inner edge of the seat.

The preferred elongated special shape of the die cut seat cover before the elastic is attached is generally indicated in FIG. 16. The front of the seat cover is lanced at 97 to show the assemblers where the tab 91 should be positioned when sewing the elastic to the outer edge 67 of the seat cover.

A regular shape of the seat cover for fitting more rounded toilet seats is generally shown in FIG. 17. Similar elements have similar numerals.

As shown in FIGS. 18 and 19, the seat cover is installed with the seat in a down position. The blue tab on the cover section of elastic is slipped under the rim of the toilet seat at the front center of the seat. Once the cover is engaged at the front of the seat, the remainder of the cover is stretched rearward toward the hinge, letting the elastic slide under the edge of the seat all around the sides, and the allowing the rear part of the elastic to lie against the hinge at the top of the seat. Then the seat is lifted touching only the cover. The five flaps are folded towards the underside of the seat, overlapping the elastic border. Then the flaps are fastened with the adhesive circular discs, and the seat is ready for use. The seat cover is removed by releasing the discs then lowering the seat and pulling the seat cover forward. The actual toilet seat is never touched.

The covered seat is ready for repeated uses while a family occupies a hotel room or while a patient occupies a hospital room.

While the invention has been described with reference to specific embodiments, modifications and variations of the invention may be constructed without departing from the scope of the invention, which is defined in the following claims.

We claim:

1. A sanitary toilet seat cover comprising a multiple use, waterproof, disposable single sheet of flexible wipeable annular die cut plastic material having an oval shape, the sheet having an outer annular portion and an inner annular portion, the outer annular portion being of size and shape to wrap around, overlie, and underlie an outer edge of a toilet seat, said outer annular portion having an outer edge with an elastic band attached thereto for pulling the outer annular portion around and under the toilet seat and close to a hinge at rear of the toilet seat with the outer annular portion assuming a position on an under surface of the seat, and said inner annular portion having an opening which is smaller than a through passage in said toilet seat, the opening having an inner edge spaced inwardly from an inner edge of a toilet seat, said inner edge having five flaps, including a frontal flap, two rear flaps and two intermediate flaps extending from said inner edge of said cover opening, when said cover is positioned on the seat the flaps will extend across the elastic band and edges of the flaps will overlap an outer surface of the outer annular portion, adhesive dots having a single adhesive surface positioned half on outer edge portions of the flaps and half on outer surface areas of the outer annular portions, further comprising a colored tab attached to the front of the seat cover for aligning with a front of the seat and a slit in the die cut material to show assemblers where to position said tab for attachment to the cover.

2. The apparatus of claim 1, wherein a rear edge of the cover opening is substantially forward of a rear edge of the seat opening.

3. The cover of claim 1, further comprising a sealed pouch containing the cover and instructions.

4. The toilet seat cover of claim 1, wherein the cover is installed by pulling the cover on the a toilet seat while the seat is in a lowered position resting on a toilet bowl, drawing the outer edge of the cover inward below the seat with the elastic rim on the outer edge of a cover as the cover is slid rearward on the seat, drawing a rear portion of the elastic rim rearwardly around a hinge on a rear of the seat, allowing five flaps to hang downward from an inner opening of the cover, lifting the seat touching only the cover, removing adhesive dots one by one from a backing sheet, attaching the adhesive dots one at a time half to edges of the flaps and half to edges of an outer surface of the cover near the elastic rim, lowering the covered seat, repeatedly using the covered seat, leaving the cover in place on the seat while a guest occupies a hospitality room and removing the cover, without having to touch the seat itself, after the guest no longer uses the room.

5. The cover of claim 4, further comprising aligning the front flap with the front of the seat.

* * * * *

UNITED STATES PATENT AND TRADEMARK OFFICE

CERTIFICATE OF CORRECTION

PATENT NO. : 5,537,693
DATED : July 23, 1996
INVENTOR(S) : Dossola, et. al.

It is certified that error appears in the above-identified patent and that said Letters Patent is hereby corrected as shown below:

Column 6, line 17, change "82" to --87--.

Drawings:

Delete drawing sheet 2 of 4 and substitute therefor the drawing sheet as shown on the attached page.

--

Signed and Sealed this

Fifth Day of November, 1996

*Attest:*

Bruce Lehman

BRUCE LEHMAN

*Attesting Officer*

*Commissioner of Patents and Trademarks*

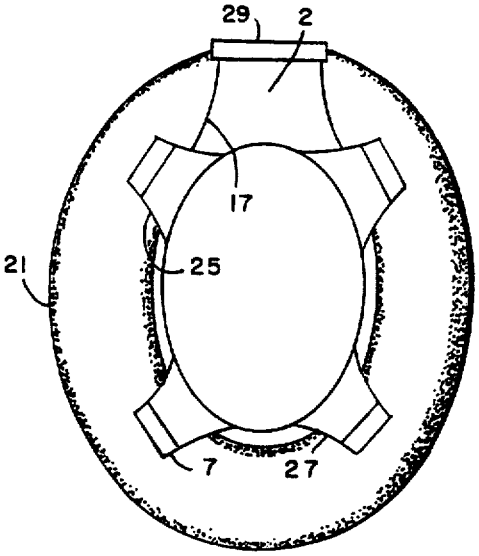
FIG. 5
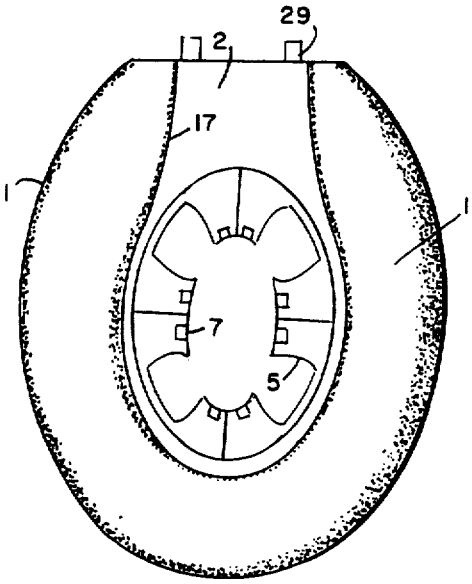
FIG. 6
FIG. 7
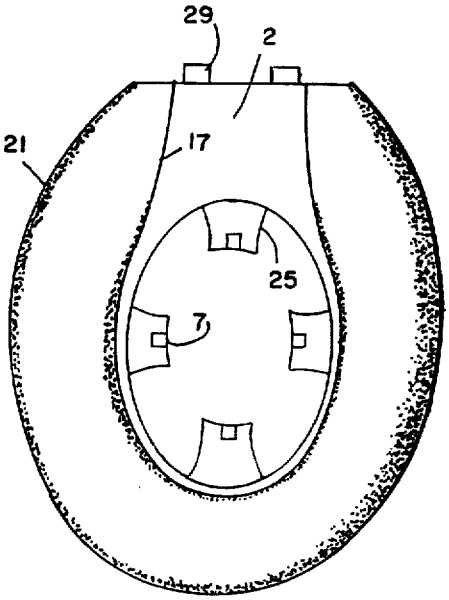
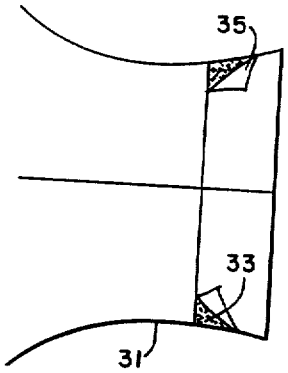
FIG. 8
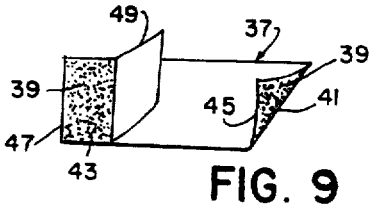
FIG. 9
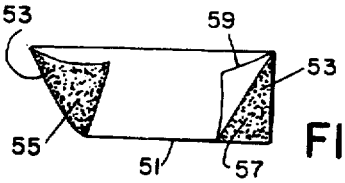
FIG. 10